US007692090B2

(12) United States Patent
Negoescu et al.

(10) Patent No.: US 7,692,090 B2
(45) Date of Patent: Apr. 6, 2010

(54) ELECTRONIC MUSICAL PERFORMANCE INSTRUMENT WITH GREATER AND DEEPER CREATIVE FLEXIBILITY

(75) Inventors: Craig Negoescu, Austin, TX (US); Lary Cotton, Austin, TX (US); Victor Wong, Austin, TX (US)

(73) Assignee: Owned LLC, Austin, TX (US)

( * ) Notice: Subject to any disclaimer, the term of this patent is extended or adjusted under 35 U.S.C. 154(b) by 1177 days.

(21) Appl. No.: 10/758,177

(22) Filed: Jan. 15, 2004

(65) Prior Publication Data

US 2004/0206226 A1 Oct. 21, 2004

Related U.S. Application Data

(60) Provisional application No. 60/440,112, filed on Jan. 15, 2003.

(51) Int. Cl.
*B27B 29/08* (2006.01)

(52) U.S. Cl. ..... 84/718; 84/600; 84/615; 84/743

(58) Field of Classification Search ..... None
See application file for complete search history.

(56) References Cited

U.S. PATENT DOCUMENTS

| | | | | |
|---|---|---|---|---|
| 4,704,931 | A | 11/1987 | Nagai et al. | |
| 5,115,705 | A * | 5/1992 | Monte et al. | 84/617 |
| 5,233,521 | A | 8/1993 | Kimpara | |
| 5,376,752 | A | 12/1994 | Limberis et al. | |
| 5,382,749 | A | 1/1995 | Fujita et al. | |
| 5,559,301 | A | 9/1996 | Bryan, Jr. et al. | |
| 5,563,359 | A | 10/1996 | Okamura | |
| 5,565,641 | A * | 10/1996 | Gruenbaum | 84/615 |
| 5,864,078 | A | 1/1999 | Koevering | |
| 5,908,997 | A | 6/1999 | Arnold et al. | |
| 5,929,362 | A * | 7/1999 | Oteyza | 84/743 |
| 6,153,821 | A | 11/2000 | Fay et al. | 84/634 |
| 6,160,213 | A | 12/2000 | Arnold et al. | |
| 6,169,242 | B1 | 1/2001 | Fay et al. | 84/609 |
| 6,229,082 | B1 * | 5/2001 | Masias | 84/645 |
| 6,353,169 | B1 | 3/2002 | Juszkiewicz et al. | 84/600 |
| 2002/0088337 | A1 | 7/2002 | Devecka | |
| 2003/0100965 | A1 * | 5/2003 | Sitrick et al. | 700/83 |

FOREIGN PATENT DOCUMENTS

| | | | |
|---|---|---|---|
| JP | 1992 4118686 | A | 4/1992 |
| JP | 1992 HEI64071 | A | 6/1992 |

OTHER PUBLICATIONS

PCT International Search Report dated Jan. 3, 2005.

Waugh, Ian, "Addictive: Ian Waugh gets hooked on the playing pleasures of the new Yamaha PSR-6000 priced at £1,999," Keyboard Player, Nov. 1994; pp. 32-35.

(Continued)

*Primary Examiner*—Marlon T Fletcher
(74) *Attorney, Agent, or Firm*—Howison & Arnott, L.L.P.

(57) ABSTRACT

An electronic musical performance instrument that provides a user with a wide array of creative choices of operating systems, sound synthesis applications, user interfaces (including those emulating the interface of a conventional musical instrument and electronic control interfaces), supporting infrastructure components such as MIDI cards, sound cards, storage devices thus providing the performance artist with greater and deeper creative flexibility.

18 Claims, 16 Drawing Sheets

OTHER PUBLICATIONS

Tan, Sarah, "Big Screen Entertainment: Yamaha announce their new flagship, the PSR6000," Keyboard Review, Nov. 1994; pp. 18-20.

KORG Trinity Music Workstation DRS Basic Guide, KORG Inc., 1995; 81 pgs.

Author unknown, "New Korg Keyboards Offer User-Friendly Power," The Music Trades, Sep. 1995; pp. 121-124.

Reid, Gordon, "The Holy Trinity? Korg Trinity Music Workstation," Sound on Sound, Dec. 1995; pp. 164-169.

"88 ways to conduct an orchestra," Yamaha MIDI Grand Piano brochure, Yamaha International Corporation, 1986; 4 pgs.

Yamaha PortaTone PSR-6000 Owners Manual, Jun. 2, 1994; 144 pgs.

* cited by examiner

ELECTRONIC MUSICAL PERFORMANCE INSTRUMENT WITH GREATER AND DEEPER CREATIVE FLEXIBILITY

RELATED APPLICATIONS

This application claims priority to U.S. Provisional Patent Application No. 60/440,112 entitled, "Electrical Musical Synthesizer with Greater and Deeper Flexibility" filed Jan. 15, 2003 and is incorporated hereby by reference in its entirety.

TECHNICAL FIELD OF THE INVENTION

The present invention generally relates to the field of musical instruments. More particularly the present invention relates to electronic musical instruments. The present invention is an electronic musical performance instrument that gives the user a greater and deeper level of creative freedom in creating sound.

BACKGROUND OF THE INVENTION

Many electronic musical performance instruments are available today. FIG. 1 illustrates a typical commonly available electronic musical instrument. These instruments typically have human input components that emulate the primary interface for human performers to interface with a conventional musical instrument. The most common such input components take the form of a piano keyboard (varying in the number of keys). However, other electronic instruments have other inputs such as pads that can be used to simulate the interface of a human with a drum or drum set or xylophone. Other interfaces such as, wind instrument or string instrument may also available.

The electronic musical instruments take the human input and convert that input into different types of audible signals. In some cases, these signals are audible sound. In some cases, the signal generated is an analog signal or in some cases a digital signal which can be converted into analog sound. These electronic musical instruments are typically programmed to generate the sound of one or more particular musical instruments —for example an upright piano, grand piano, organ, guitar, electric guitar, etc.

These electronic musical instruments typically employ the use of electronic processors running proprietary sound generation hardware and software for converting the input into an audio signal.

Although they are not musical instruments, personal computers have been used as musical synthesizers to generate musical sounds. In fact, many different personal computer (PC) based musical synthesizer software programs are available. These systems are based on standard PC infrastructure. The PC runs an operating system and the sound synthesizer software can run on top of the operating system. Some of these programs are proprietary and some are non-proprietary. Input devices such as a piano style keyboards are available that can be used as inputs to the PC software system. FIG. 2 illustrates such a device. Typically, these input devices connect to the PC through a MIDI communication card installed in the computer or through some other communication interface such as USB or Firewire which are well known in the personal computer and personal computer software arts.

However, both existing electronic musical performance instruments and PC sound synthesizer systems have significant creative and practical limitations. The PC systems are not suitable for a live musical performance environment. They are not "road worthy" and require a great deal of set up, are designed for a fixed set up, and after set up take a relatively long time to boot up and generate music. On the other hand existing performance electronic instruments also have limitations. For example, prior art musical instruments limit the user to their proprietary sound generator. Additionally, they must be connected to a host computer to gather sound files and patches. These embedded hardware instruments are inherently and intentionally more limited in their ability to compose music because they are built around memory, ergonomic, and display screen restrictions. Furthermore even where they allow modification, electronic instruments frequently are limited by file format restrictions. For the similar design considerations as those mentioned immediately above, electronic instruments use proprietary storage formats based on standard technologies i.e., floppy drive with non-standard file format. An electronic musical performance instrument with greater creative flexibility is desired.

BRIEF DESCRIPTION OF THE DRAWINGS

A better understanding of the present invention can be obtained when the following detailed description of various embodiments is considered in conjunction with the following drawings, in which:

FIG. 14 is an illustration of the alpha control element components from the control module illustrated in

FIG. 13;

Figure 1:
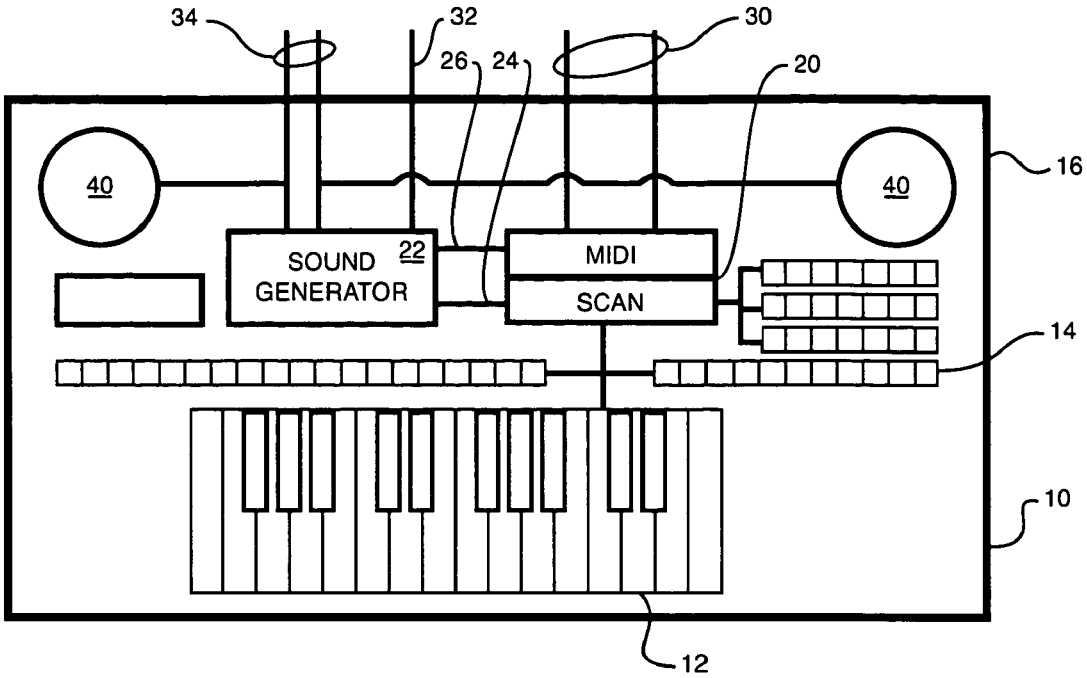
FIG. 1 (PRIOR ART)
FIG. 1 illustrates major components of a conventional electronic musical performance instrument (prior art)

While the invention is susceptible to various modifications and alternative forms, specific embodiments thereof are shown by way of example in the drawings and are described below in greater detail. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the claims.

DETAILED DESCRIPTION OF SEVERAL EMBODIMENTS

FIG. 1 is a block diagram illustration of major components of a typical electronic musical performance instrument 10. The primary user interface is typically similar to that of a piano keyboard 12. A conventional electronic instrument also incorporates other input devices 14 to for selecting various sound generation options. For example, selecting the sound of an upright piano, grand piano, organ, harpsichord trombone, drums etc.; or for controlling parameters of the sound for example vibrato tremolo, volume, timbre, waveform and many others. These examples are merely illustrative of options that are available for electronic musical instruments.

Inside the housing 16 these instruments contains electronic hardware and software which provide certain functionalities. For example, conventional electronic instruments include circuitry 20 and software (not shown in FIG. 1) for scanning the keyboard 12 for input and scanning the other input devices 14 for input and settings. The scanning hardware 20 and software converts the control input and control settings into data that is made available to a sound generator 22 via communication link 24 and/or 26. In some cases, the data format generated by the scan hardware 20 and software is based on a proprietary protocol. However, it is not unusual for the signal to be in MIDI format. MIDI is a standard serial hardware and data protocol promulgated by the MIDI Manufacturer's Association (MMA). Many conventional electronic instruments allow the user to turn off the local connection 24 and/or 26 so that you can use another device to manage the relationship between the keyboard 12 and control inputs 14 on the one hand and the sound generator 22 on the other. In addition to the internal communication link 24 or 26, such instruments typically will provide a MIDI communications link 30 to connect the instrument 10 to other devices (not shown).

The data received by the input scanning hardware and software 20 is made available to a sound generator 22. The sound generator 22, comprised of the manufacturer's proprietary hardware and software, processes the data to create digital and or analog audio signals. Typically, the sound generator 22 provides these digital audio signals and analog audio signals to other devices via links 32 and 34 respectively. Some of these instruments incorporate speakers 40 connected to the analog audio link internal to convert the analog audio signal into an audible sound signal (music). There are other types of electronic keyboards 50 available.

Figure 2:
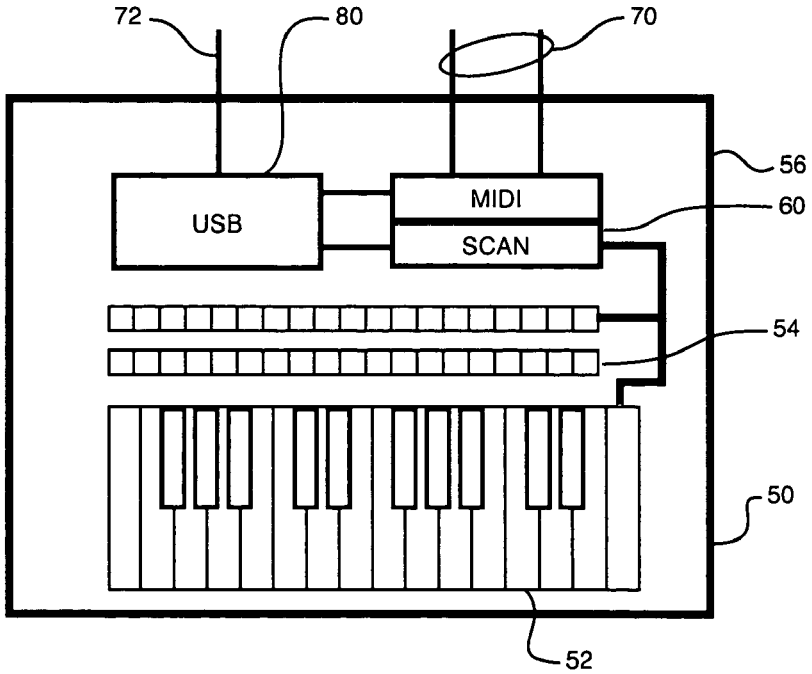
FIG. 2 (PRIOR ART)
FIG. 2 illustrates a conventional music style keyboard which can be used with a personal computer (prior art)

FIG. 2 is a block diagram illustration of major components of these devices. Although these devices have an input keyboard 52 similar to the keyboard 12 described above for the synthesizer 10 from FIG. 1 and appear similar to a musical instrument, they are not instruments because they are incapable of generating sound or electrical sound signals. However, they frequently include scanning hardware 60 and software similar to that described above. In these devices, the data signal from the scanner 60 is made available to other communication protocol hardware and/or software such as USB. USB is an acronym for Universal Serial Bus which is a personal computer industry standard communications link protocol. In addition to providing a MIDI link 70, these devices also provide a USB link to enable the device to be connected to other devices.

Figure 3:
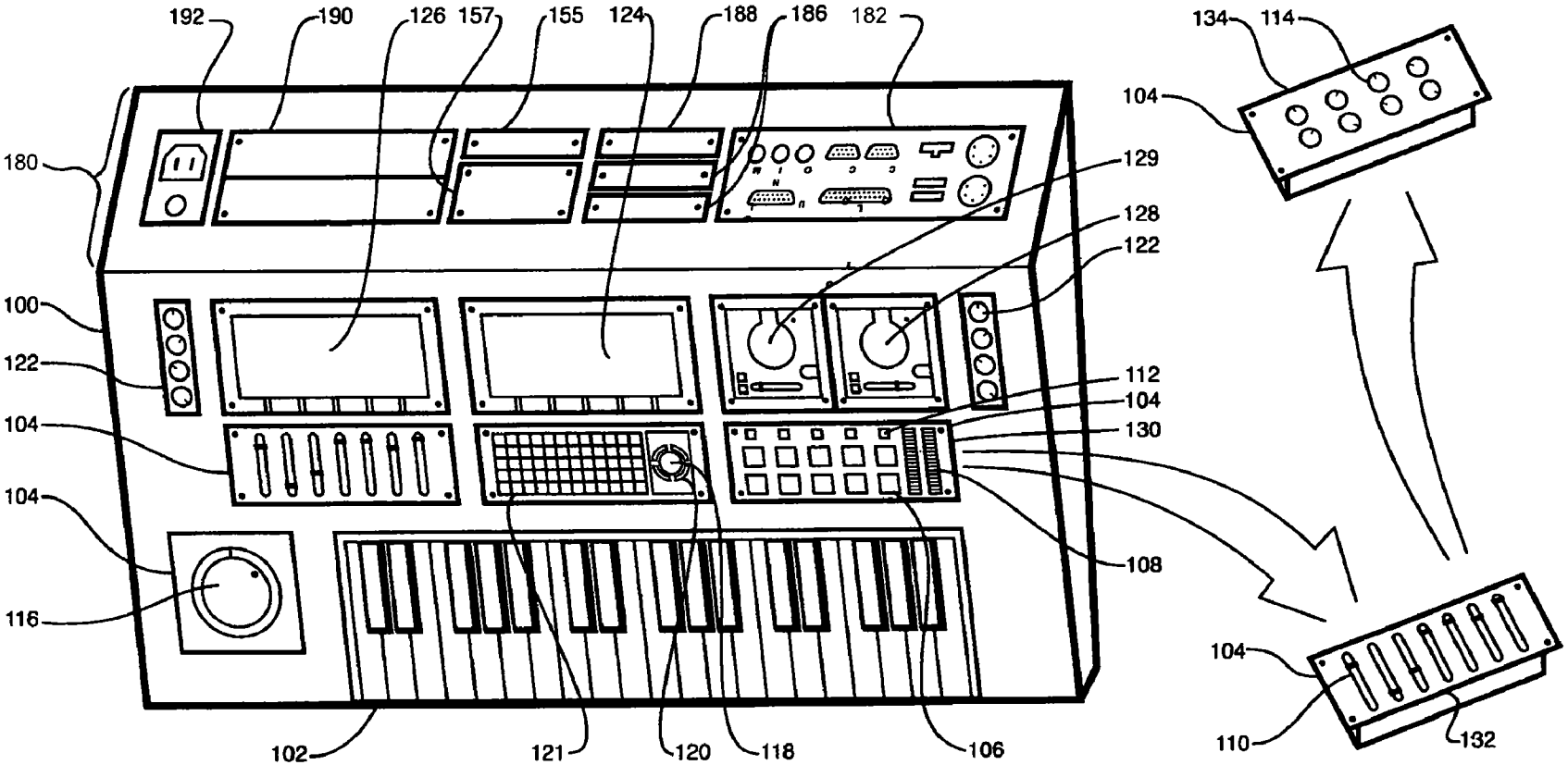
FIG. 3 is an illustration of and embodiment of the improved electronic musical performance instrument, in this illustration the backside of the unit is shown folded up for illustrative purposes.

FIG. 3 illustrates an embodiment of an improved performance electronic musical instrument 100. It employs a 61 note full-size keyboard 102 with velocity and after-touch sensed keys arrangement familiar to a musical performer. In alternative embodiments different key numbers keyboards may be used. Examples of other common key configurations include a 76 note or a full grand piano 88 note configuration. However, as previously discussed, other types of interfaces are also available and may be preferable for some applications. For example, a set of pads may be more appropriate for a user that intends to create percussive sounds. For convenience, this description may use the term keyboard to refer to this aspect of the user interface without limitation. The keyboard aspect of the user interface contemplated is of the type conducive to manipulation similar to the manipulation of a more conventional instrument used by a musical performance artist. The instrument 100 also employs various setting and control interface devices 104 like program select or change keys 106 wheels for adjusting pitch, modulation and/or other parameter 108, sliders 110 for adjusting volume or other parameters, toggle buttons 112, foot switch/pedal inputs [¼ inch phone plug's on the back of the unit (not shown in this figure) Other control inputs are also possible—such as dials 114 or jog and shuttle wheels 116 switcher handle (not shown), T handle (not shown), surround panner joystick (not shown) or a touchpad and buttons (not shown), buttons or multi-setting buttons (not shown). In the embodiment shown, the synthesizer also contains an input device 118 & 120 familiar to users of personal computers. FIG. 3 illustrates a track ball 118 with four selection keys 120 arranged around the trackball 118. In other embodiments, other pointer devices could also be employed. The embodiment illustrated in FIG. 3 also includes an alphanumeric style keyboard which is also familiar to users of PCs. The embodiment shown also includes speakers 122 for generating sound. The speakers 122 are not a necessary component. However, if there are no speakers, the instrument should have output links discussed in greater detail below) for outputting either digital sound signals, or analog sound signals, or both digital and analog sound signals.

The embodiment illustrated in FIG. 3 also includes two displays 124 & 126. It is not necessary to have the two displays—or even a single display. However, it is desirable to have at least a small display to reflect the current state of the device. Additionally, especially in higher end embodiments, it would be desirable to have at least the ability to connect a display to the instrument to facilitate the user's efficient interaction with the instrument. (This will be appreciated more in the discussion below.)

The two displays illustrated in the embodiment of FIG. 3 are used to display different types of information. The middle display 124 can be used to display sheet music the other display is shown illustrating control settings and/or other information about the sound generated or how input is being manipulation by the sound generator inside the instrument and other electronic components in the instrument discussed below. In an embodiment of the invention the display is a touch screen display. With a touch screen display the user can control the operation of the instrument directly on the display.

FIG. 3 also illustrates a removable storage media device 128. In this embodiment, a CD ROM Read/Write drive is illustrated. It should be understood that other removable storage devices might be employed in place of or in addition to a CD ROM drive. It should also be appreciated that a removable storage device is not strictly necessary to the invention.

However, if no removable storage device is provided, there must be communication links enabling the instrument to connect to a removable storage device and/or a network from which electronic media can be downloaded and/or uploaded such as USB, Firewire (common name for IEEE communications protocol standard 1394a, Ethernet or Wireless (for example IEEE 802.11b, 802.11g and/or Bluetooth WiFi standard compliant hardware/software) protocol connections. This types of connections make it possible to interface with the instrument using other wireless human interface devices (HIDs) such as wireless pointing devices and wireless alphanumeric keyboards or additional musical piano style keyboards or musical interfaces which may be connected wirelessly though a wireless protocol connection or through a Firewire or USB wired connection.

Another important feature of the instrument illustrated in FIG. 3 is the modularity of the input components. For example, the input module 130 is interchangeable with other modules, for example module 132 or 134. Similarly, the other modules illustrated as 104 and the other modules such as 126, 124, 122, 102 and 121, 120, 118 (as a unit) can be interchanged with other components. In some cases, one module can be replaced by multiple modules, for example display 126 could be replaced by two modules like 128 and 129. Conversely, in some cases, two modules in one slot can be replaced by one module. For example, modules 128 and 129 could be replaced by the display module 126 or 124. Many other modules are contemplated —for example, DJ style CD players similar to modules 128 and 129. Other DJ style input modules, like scratch players, are possible options. Additionally, many different combinations of these modules are contemplated.

Figure 4:
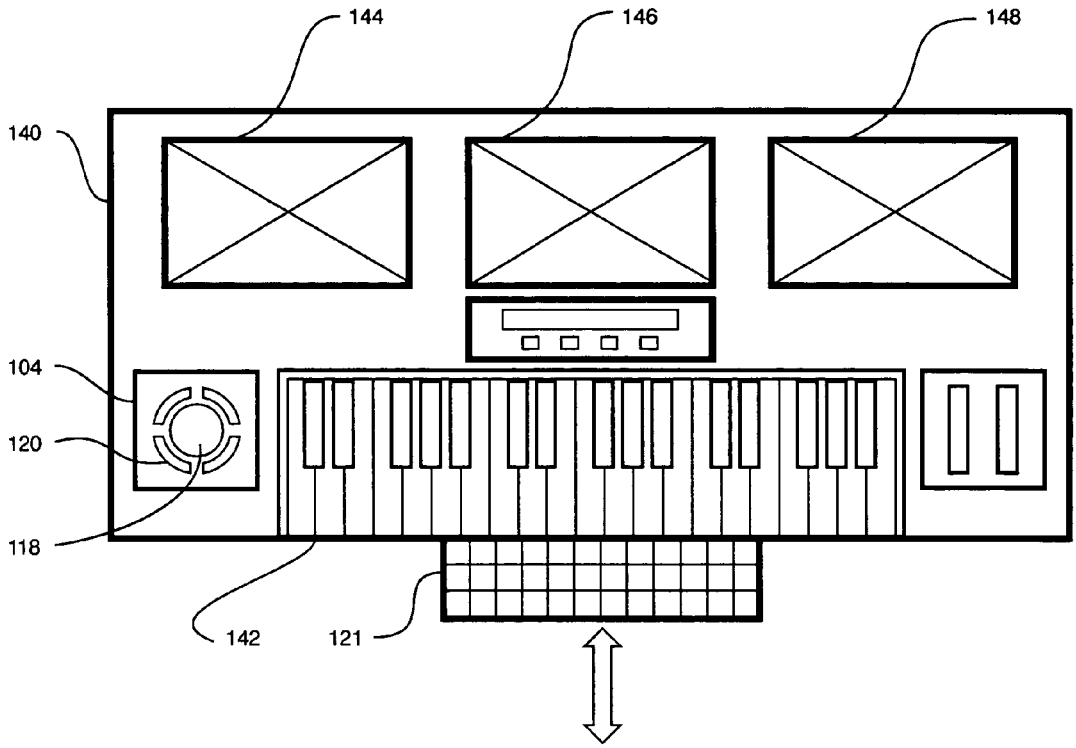
FIG. 4 is an illustration of an alternative configurational embodiment of the improved electronic musical performance instrument.

FIG. 4 illustrates an alternative embodiment 140. It also includes a piano style keyboard 142. In addition includes slots 144, 146 and 148. These slots can incorporate modules like the ones described above and illustrated in FIG. 3. FIG. 4 also illustrates a pop-out alphanumeric keyboard 121 that can be popped back into the instrument when the alphanumeric keyboard is not needed. Many other module configurations are also within the spirit of the present invention. For example in some embodiments, the module includes a discrete analog circuit for processing an audio signal. These embodiments control modules may have an analog audio-in port for receiving an analog audio signal to be processed by a discrete analog circuit. In other embodiments it may have an audio-out port for outputting an audio signal which has been processed by the discrete analog circuit. Other embodiments may have both audio in and audio out ports. These boards may also include analog to digital converters or digital to analog converters for passing the audio signal to and from other components of the system to be processed. Other control module embodiments with discrete analog circuits, the module may have a digital input and/or output port(s).

In other embodiments the control module may include copy protections circuitry for example a security key stored in hardware that the system looks for to allow proprietary software applications to operate. For example, in some cases it may be desirable to provide the user with software for a particular functionality. It may be desirable to only allow that software to operate or have full functionality if the associated hardware module is purchased and installed in the system.

Figure 5:
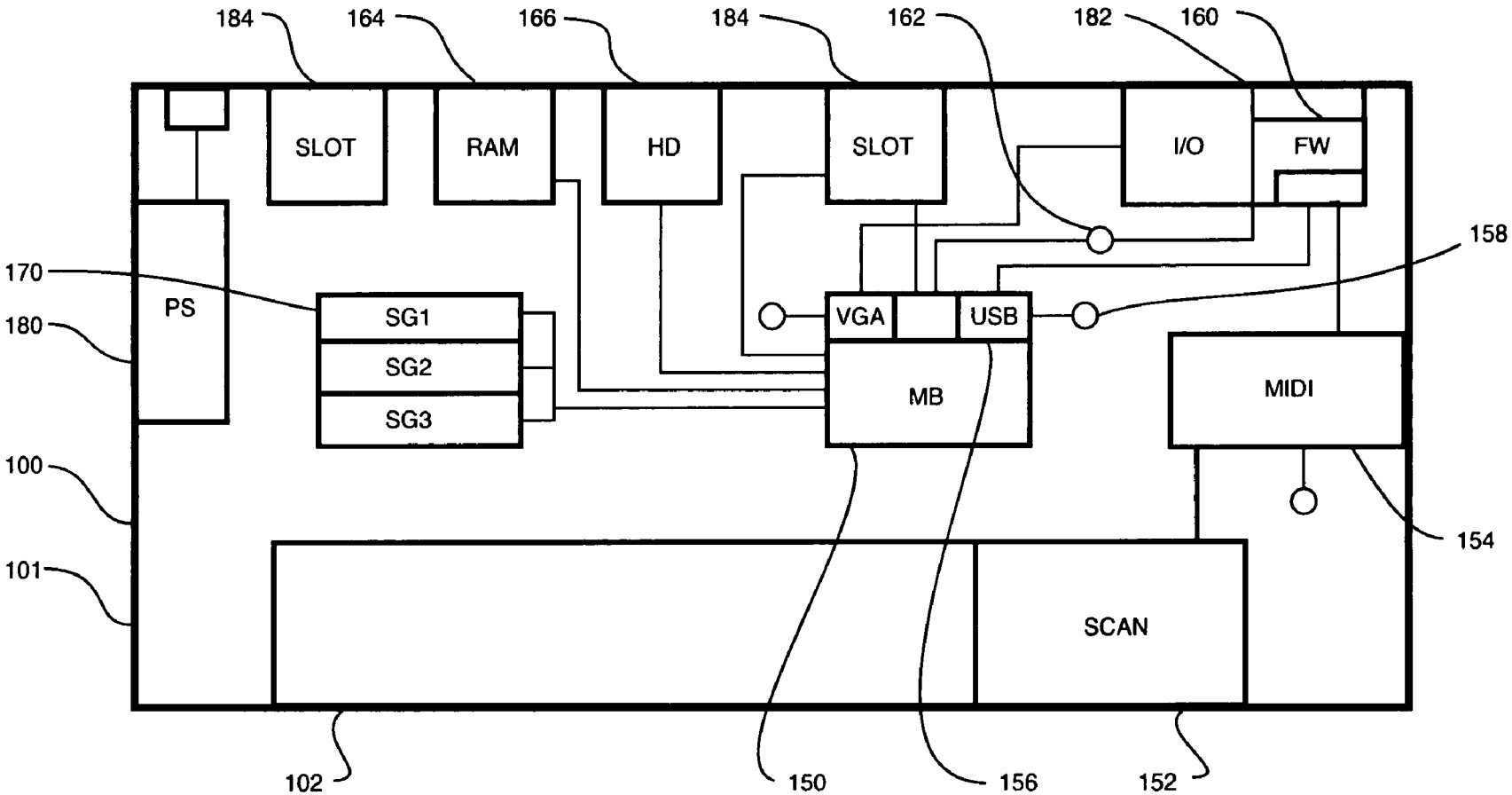
FIG. 5 is an illustration of major components of and embodiment of the improved electronic musical performance instrument.

FIG. 5 illustrates major internal components of the embodiment of the invention 100 illustrated in FIG. 3. The anchor of the electronic circuitry in the instrument is a personal computer processor mounted on a PC motherboard 150 in one embodiment the motherboard is a micro ATX motherboard. The modules like keyboard module 102 are electronically connected to the motherboard through scanner hardware and software 152 which scans and monitors the status of the keyboard keys. In the preferred embodiment the keyboard module is interchangeable and the scanner hardware and software is integral with the keyboard module 102 so that when the keyboard module 102 is removed, the scanner circuitry is removed with the keyboard elements. In the embodiment shown, information collected by the scanner hardware and software 152 is transferred to the motherboard 150 either directly (not shown) or via MIDI communications hardware and software 154. The MIDI module 154 in the embodiment shown in FIG. 5 is also in modular form so that it can be removed and swapped with a different MIDI card through an access panel (not shown) in the side of the instrument. In alternative embodiments, the scanner hardware could send its information directly to the motherboard 150 via circuitry (not shown) on the motherboard 150 designed to support receipt of such information. In alternative embodiments, the keyboard module could include USB circuitry which can be connected to USB circuitry 156 on the motherboard 150 via a USB link 158. Alternatively, the modules may employ Firewire circuitry connected to Firewire circuitry 160 on the motherboard 150 via a Firewire link 162. In addition to, or in place of USB connections or Firewire connections or MIDI, other communication protocols are possible in alternative embodiments. Although it is not shown in FIG. 5, the same types of connections are suitable for the majority of the other modules shown in FIG. 3 and described in relation thereto above. In a prototype of the unit, the inventors used primarily USB connections for most of the input modules but used VGA connections for the monitors since this is a common connection method for component monitors. However, it is not necessary that the monitor be connected via VGA.

The motherboard 150 runs a conventional proprietary personal computer operating system (OS) like Microsoft Windows or a Unix OS like the open source Linux OS. In the embodiment shown, the computer processor on boot up turns to a high-speed boot drive 164. Although any high-speed drive would serve this purpose, in the preferred embodiment, the inventors utilized a RAM array for this purpose. In the preferred embodiment, the high-speed boot drive 164 contains select portions of the OS (optimized version of the OS—for example a boot speed optimized version of Windows XP) in order for the performance instrument to be immediately (or—close to immediately) operable to generate sound. If the high speed boot drive 164 is large enough or the OS selected is small enough, the high-speed boot drive 164 can contain the entire OS and perhaps select portions or all of the sound generation application(s) 170 discussed in greater detail below. A RAM array is very quick and can be reconfigured with new code after the device boots, if modification is desired. In the event that the boot drive 164 does not contain sufficient storage capacity, the remainder of the OS code may be accessible from a conventional hard drive 166 connected to the motherboard 150. Non-volatile magnetic random access memory (NV/MRAM) chips are particularly suitable to serve as the high speed boot drive 164. The number of chips necessary in the array depends on the size of the OS and software desired to call up quickly. In the preferred embodiment, both the boot drive 164 and the hard drive 166 are incorporated in the housing 101 of the instrument 100 so that they can be accessed and replaced through access panels 155 and 157 respectively (shown on the back of the unit in FIG. 3).

Figure 7:
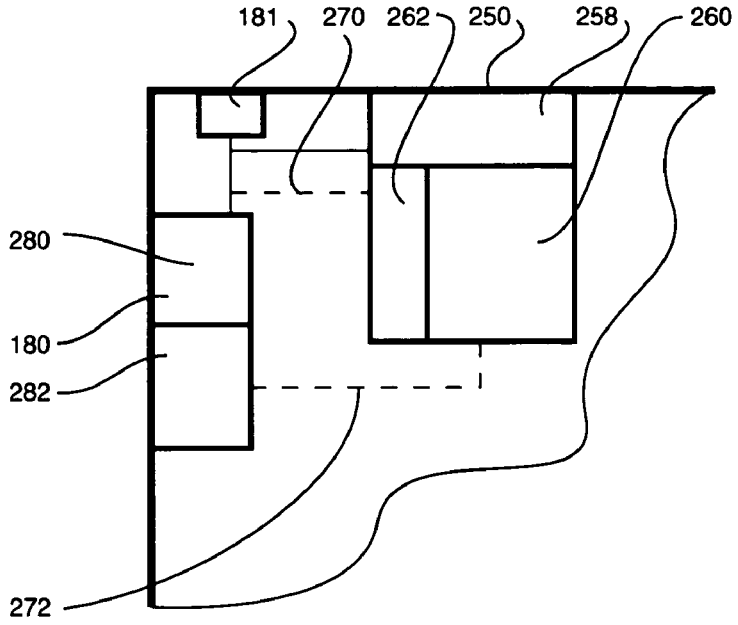
FIG. 7 is an illustration of an alternative embodiment of the power supply system.
Figure 8:
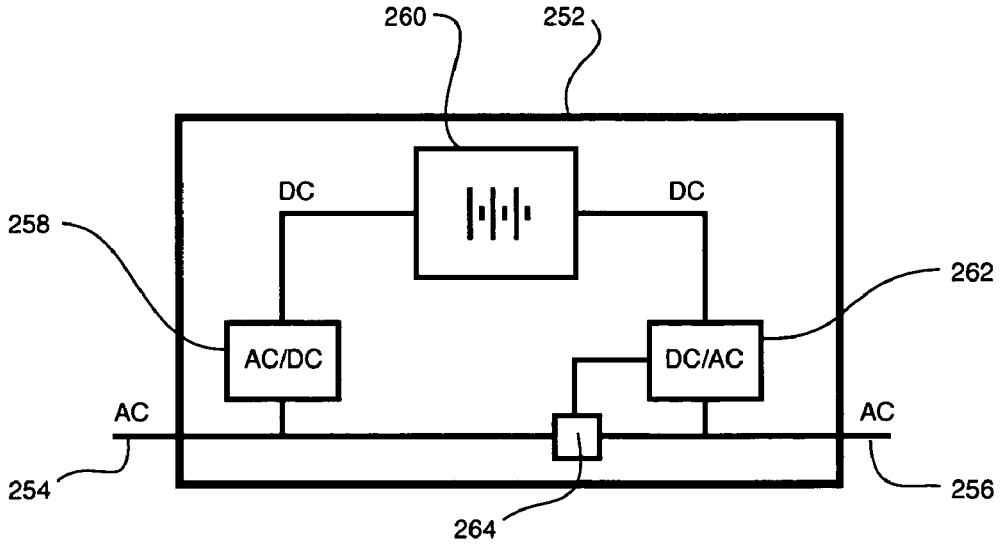
FIG. 8 is an illustration of the functional components of a typical uninterruptible power supply.

FIG. 7 illustrates an alternative embodiment of the new performance instrument. In this embodiment, the instrument contains an uninterruptible power supply 250 to power the electronic components of the instrument. A conventional uninterruptible power supply is illustrated in FIG. 8. The conventional uninterruptible power supply (UPS) typically contains circuits that perform certain functions. FIG. 8 illustrates these circuits by functionality. Through input 254, UPS 252 typically receives conventional AC power from conventional power outlet (not shown). Typically this power is passed through the supply by line 255 to the UPS output 256. The input 254 power is also provided to circuitry 258 for converting the AC power into DC power. The DC power is used to charge a battery 260. Circuitry 262 senses via circuitry 264 whether there is power on the outlet 256. If it senses an interruption in power it immediately begins to convert DC power from the battery into AC power and supplies it to the outlet 256 while at the same time limiting leakage vial circuitry 256 of power to the inlet 254. Some UPSs, sometimes called continuous UPSs (not shown), do not pass AC current from the inlet 254 to outlet 256. These UPSs supply power from the DC to AC power converter 262 as long as power is supplied to the inlet 254 or there is sufficient charge in the battery 260.

FIG. 7 illustrates two different embodiments of a UPS depending on which connection 270 or 272 is used to connect the UPS 250 to the ordinary power supply 180. In FIG. 7 the power supply 180 is shown with two parts, the AC/DC component 280 and the DC component 282. The AC/DC component 280 may be of the type that can convert a single, or different, type(s) of AC power into one or more different voltages of DC power. The DC component 282 might be of the type that can receive and distribute different DC voltages from the AC/DC component 280 to the electronic components of the instrument as needed. The DC component 282 may also be of the type that converts different one DC voltage received from the AC/DC component into different DC voltages and distribute the power to the electronic components of the instrument as needed.

In the embodiment that uses connection 270 between the UPS 250 and power supply 180, the UPS 250 also incorporates DC to AC conversion circuitry 262 in either configuration described in the paragraph above. In the embodiment that uses connection 272 between the UPS 250 and power supply 180, the AC/DC converter 262 is not necessary. The DC from the battery is supplied directly to the DC component 282 of the power supply 180.

Figure 9:
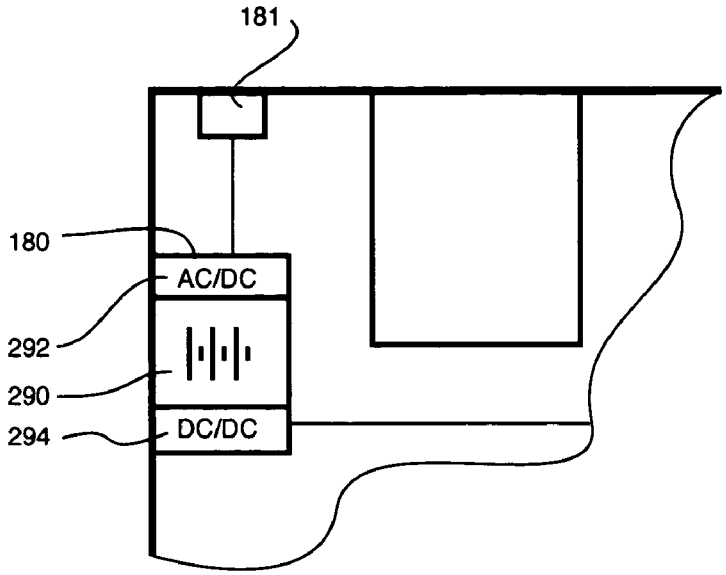
FIG. 9 is an illustration of an alternative embodiment of the power supply system.

In the embodiment shown in FIG. 7, an open modular slot was used to house the UPS 250 and the power supply 180 was used to distribute the power to the electronic components of the instrument. In alternative embodiment the module UPS can/could include circuitry for performing the necessary conversion and distribution tasks provided by supply 180. Another embodiment is shown in FIG. 9. The Power supply 180 is not modular but incorporates a battery 290 to convert the power supply into a UPS. In this embodiment the power supply provides DC through an AC/DC converter 292 to charge the battery and then directly, or through the battery 290, to a DC/DC converter 294.

Figure 10:
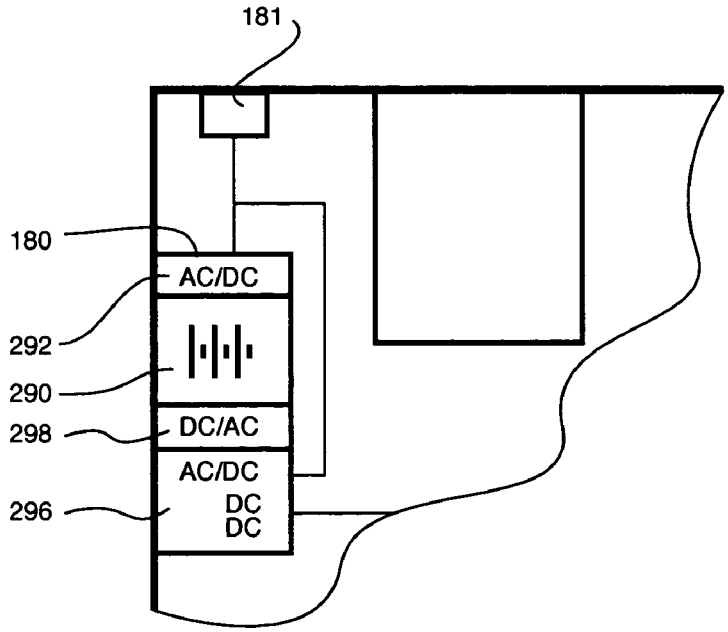
FIG. 10 is an illustration of an alternative embodiment of the power supply system.
Figure 11:
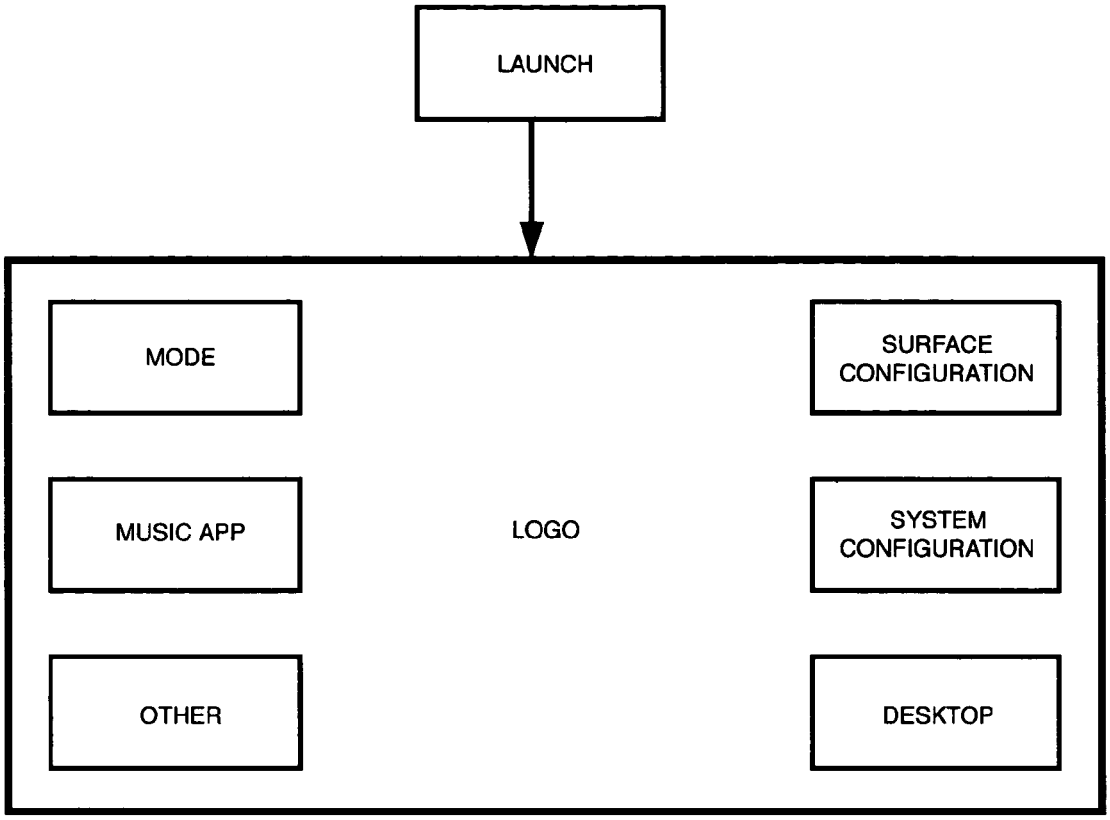
FIG. 11 is an illustration of a user selection interface.
Figure 12:
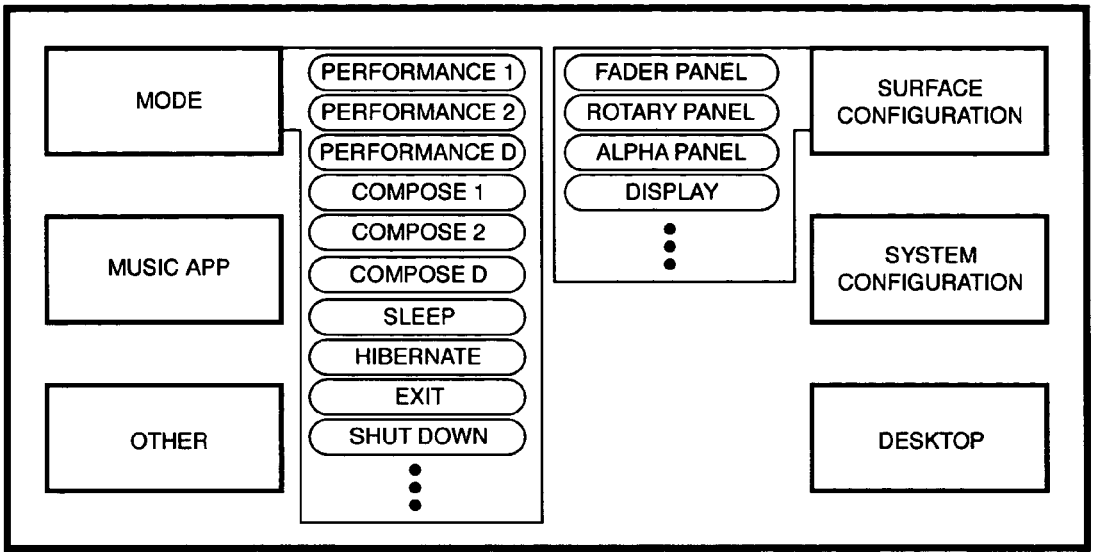
FIG. 12 is an illustration of detail expanded views of categorized selection options for two of the options shown in FIG. 11.

Another embodiment is shown in FIG. 10. In this embodiment, the power AC is fed to the AC/DC converter 292 and to circuitry 296 that converts AC to multiple DC voltages. In this embodiment the battery must also be connected to circuitry 298 that can convert the battery power from DC to AC to power the AC to multiple DC voltage circuitry 296. In an alternative embodiment the Instrument provides boots up a selection menu that provides easy access to functionalities of the instrument. This selection menu may be user alterable to add or delete selections. In some embodiments the selection menu automatically or semi automatically modifies itself when recognizable software or hardware modules are installed or removed from the instrument. One embodiment of this is shown in FIG. 11. In this embodiment the user is provided with a choice of options: 1) Mode of Operation 2) Open a Music Application; 3) configure a surface control interface; 4) Configure other system components or functions 5) proceed to the desktop of the operating system; and 6) other uncategorized options. Each of these choices may open another interface as a whole or partial window and embodiment of which is illustrated in FIG. 12 for the surface configuration option (which in the embodiment shown expand to selecting configuration of: 1) the fader panel; 2) the rotary controller panel; 3) the alpha control panel 4) this main display 5) etc. It also shows an expanded view of one embodiment of the mode options including: (performance 1, performance 2, performance d (for default) music application selections including: 1) v-stack; 2) Cubase; 3) Orion Pro; 4) Reason 5) etc. These examples shown are all commercially available applications.

Although applicants believe it is preferred to have as many of the choices pop up in a common interface, in alternative embodiments the user can be presented with a series of selections which may expand or contract depending on the selections made. With the power supplies shown and described, it is possible lose mains power and continue to operate the instrument uninterrupted. Additionally, it is possible to put the instrument in a sleep mode which allows for lower power usage and at the same time it can quickly arise. It also allows for a hibernate mode which requires less energy usage but, on the other hand requires more time to wake come to a fully operational state. These power supply improvements to a performance instrument can be used in alternative to the RAM drive or in addition to the RAM drive that allows for quick start of the instrument.

In the embodiment shown, the OS has the option of sending the information to one of three (3) sound synthesis programs 170. In the embodiment shown, the user is provided with an option of selecting from a number of sound synthesis software packages. In this embodiment, it is also possible to add additional software packages assuming they are compatible to the OS running on the computer processor or may delete existing sound synthesizer software packages. These software packages may be proprietary to the manufacturer, or to a third party, or to the user. It is not important that more than one option be available to the user at a time—what is important is that the user has the creative option of selecting her own sound generation software package. In the embodiment shown, the OS running on the computer processor may also be replaced with another OS. In both cases, OS and Sound Synthesizer software the code may be open source or proprietary. To facilitate the option of an open source OS, in the preferred embodiment, the scanning software for the keyboard and/or other user input interface devices is/are also open source and open for modification.

FIG. 5 also illustrates a power supply 180 for receiving line voltage and converting that into power suitable for use for the needs of the electronic circuitry in the instrument. In addition to the boot drive 164 (RAM in this case) slot, MIDI 154 slot, the instrument includes other slots 184 which will be discussed more in light of their access ports below.

Returning to FIG. 3, the back panel 180 of the instrument is shown folded up for illustrative purposes. In the unit upon which this FIGURE is based the back panel is not actually visible from the front of the Unit. The back panel illustrates an input/output module 182. In this embodiment of the invention this panel is an interchangeable module. In the embodiment the module largely serves to pass through the various input and output links to other parts of the system. For example, the Motherboard 150 in the embodiment shown has its own USB support circuitry 156 which provides a USB link to other components inside the housing or to modules to provide a communications link inside the unit. A link is also passed through the I/O module to provide USB link(s) to external devices. Although not shown in FIG. 3, the I/O module contains USB hub circuitry to allow for a larger number of USB connections to modules internal to the unit or USB memory cards and on the I/O module 182 panel for connection to external devices.

Figure 15:
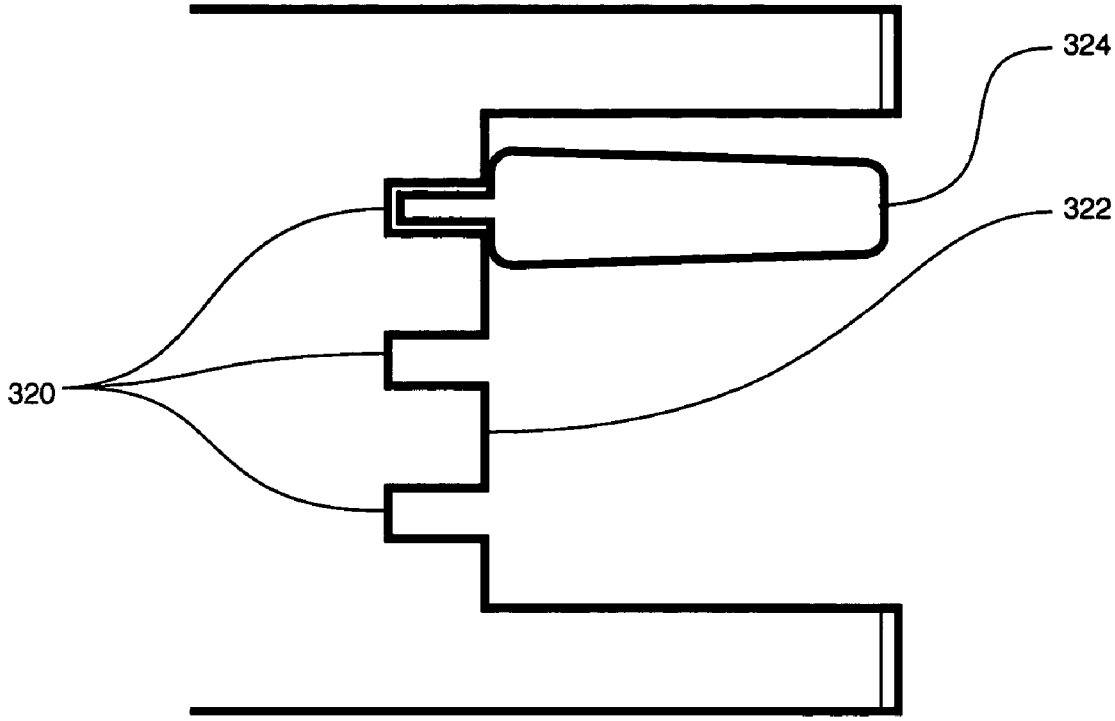
FIG. 15 is a cross-sectional illustration showing recessed USB ports for receiving USB Memory Sticks.

FIG. 15 illustrates a feature of the External USB connections. The figure illustrates in cross-section that the USB connections 320 are mounted on a recess section 322 of the unit. The purpose of the recess is to protect USB memory cards 324. These memory cards can contain copy protection keys that enable the operation of proprietary software. If the USB keys 324 are mounted to USB port connections inside the unit they are protected from accidental disconnection by being internal to the unit. If they USB keys are connected to the external ports illustrated in FIG. 15 then the recess protects accidental removal of the keys. Although it is not shown in FIG. 15 in alternative embodiments the recessed section can be further protected by a covering that can be opened to expose the connections or closed to shut out access to the ports. These recessed USB ports can also be incorporated into other peripherals such as stand alone displays or into rack mount units.

Figure 6:
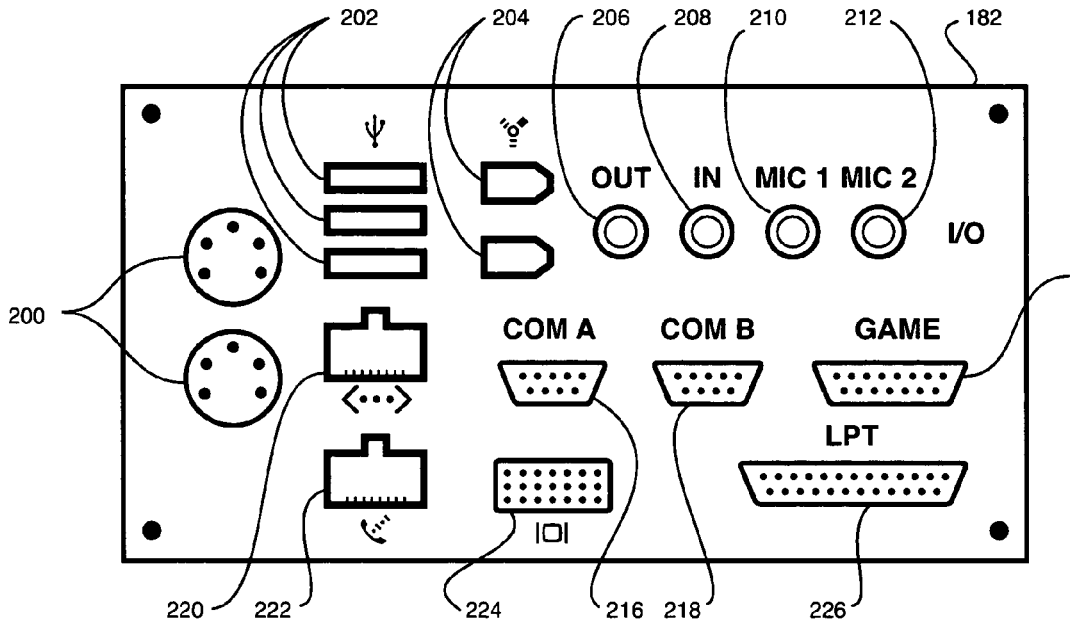
FIG. 6 is an illustration of input output links for connected the performance instrument to external devices.

Additionally the I/O module 182 may contain other electronic circuitry. For example, in the embodiment shown the I/O module provides Firewire circuitry for providing Firewire link(s) 162 to the inside of the unit to make it available for optional modules to communicate with the motherboard 150. This is because the motherboard selected and illustrated in FIG. 3 does not contain Firewire support circuitry. This circuitry also provides a link to the front panel of the module to provide a Firewire link to external devices. FIG. 6 illustrates and embodiment of the front panel of an I/O module 182 and will be discussed in greater detail below. The back of the unit also contains panels 186 covering slots for installing additional components to the system so that the user has the option of adding alternative sound or video interfaces to the motherboard 150. In the embodiment shown the slots are 5 ¼ inch slots that provide PCI ports to the motherboard 150. The back panel also provides a PC Card/ CardBus slot(s) 188 for accepting Type I or Type II PC Card(s) with connections to the motherboard 150.

As mentioned above, FIG. 6 illustrates the front plate of the I/O module 182 of the embodiment of the invention illustrated in FIG. 3 & FIG. 5. This embodiment illustrates: 2 PS2 connections commonly used with alphanumeric keyboards and pointer devices; three USB links 202; two Firewire links 204; ¼ inch mic connectors for audio out 206 audio in 208 and two mic inputs 210 & 212; a gaming system link 214 for systems like a Sony Playstation 2; two additional com ports 216 & 218; an Ethernet port 220; a phone line modem port 222; DVI video port 224 (or VGA port); and a LPT port. Although it is not shown in the figures but was mentioned above, the embodiment of the instrument also includes a wireless 802.11b link by means of circuitry and software to run the circuitry. In the alternative other wireless protocols may be used such as 802.11g and/or Bluetooth. A novel feature of this wireless link is that the software allows the wireless link to output MIDI in a wireless form. Although it does not comply with the electrical portions of the MIDI standard, a wireless receiver running the same software can convert the signal back into standard MIDI format through the use of standard MIDI electronics.

Through the Ethernet port, the instrument 100 can be connected directly to the Internet or another computer network or a network of the inventive performance instruments. With browser and or email software files or applications can be downloaded from the network for quick use. Additionally, files can be uploaded for sharing or for safekeeping. These files could include music files, performance files, system configurations etc. In this way a performer can configure his instrument at home, create a show say Los Angeles, upload the configuration and show files using an internet connection, fly to London, use another of the inventive performance instruments, download the files from the internet and be ready to perform. If the performer wants assistance from an associate back in Los Angeles, an email can be sent with instructions, the associate can create what is required and email it to the performer in London. This could work just as well across town rather than over continents.

Figure 13:
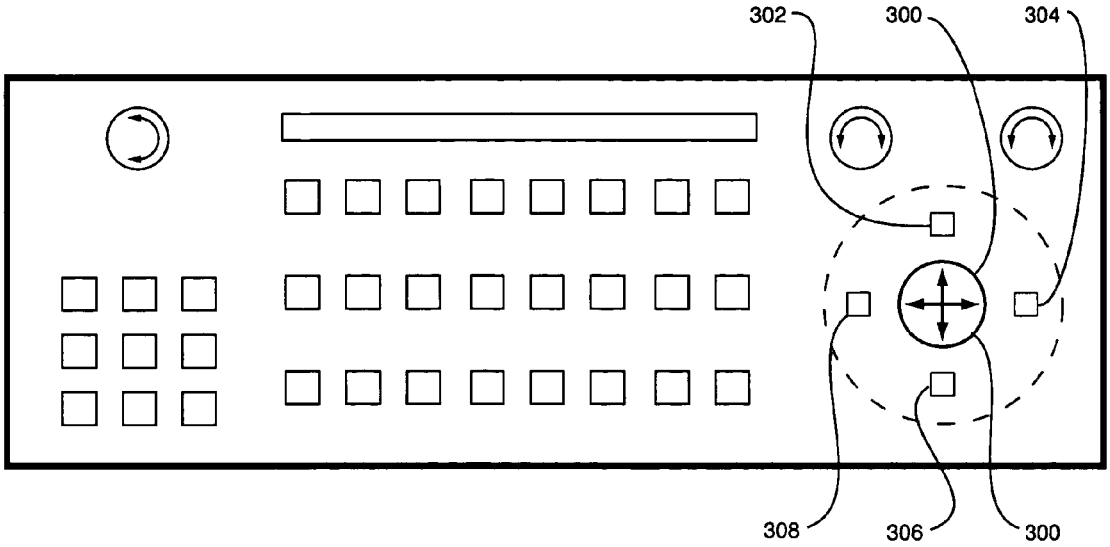
FIG. 13 is an illustration of an a control module containing a novel alpha control element.
Figure 14:
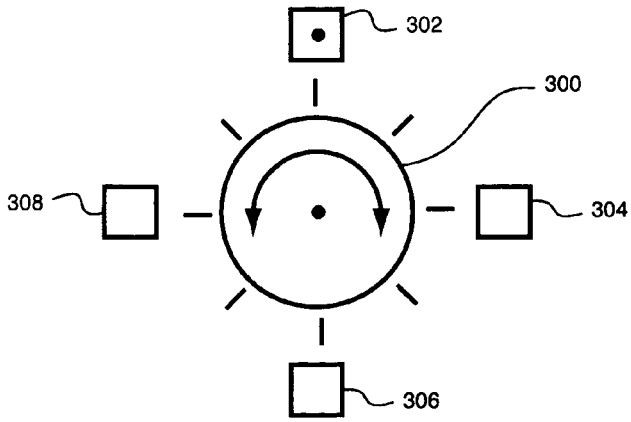

FIG. 13 illustrates a novel control input element of the present invention. In one embodiment of the invention this control input element is used as the alpha control for the system. The novel input element is illustrated in greater detail in FIG. 14. In the embodiment shown, the element has 5 components 300, 302, 304, 306, and 308. In one embodiment all of the elements can take input by pressing down and releasing. The center component also can receive other types of input. It can take input by movement like a joystick. In one embodiment is it has sensors at every 45 degrees, in addition it can interpolate between the sensors. In one embodiment it can interpolate for a total of an effective 16 points or every 22.5 degrees. The center component 300 can also take information by being rotated like a conventional alpha control input. These components can be configured to operate in a variety of ways which allows the performer to input controls more quickly. For example is a linear series of 16 input channels with fader type controls, this control element can be programmed so that the outer buttons 304 and 308 can take you to either extreme of the selection of input channels (ex. channel 1 for 309 and channel 16 for 304). The joystick could allow you to jump from left one channel at a time by lateral movement and allow you to set the level of the selected channel. The top and bottom button 302 and 306 can take the faders to the top extreme 302 or the bottom extreme 306.

In a rotary array configuration, buttons 308 and 304 can move to the left most or right most extreme dial respectively in a row. Buttons 302 and 306 and move to the top or bottom most dial, respectively, in a column. The joystick movement of element 300 can move incrementally left and right or up and down. The rotary movement of element 300 can control the setting of the dial. Many other alternatives are also contemplated and possible.

Figure 16:
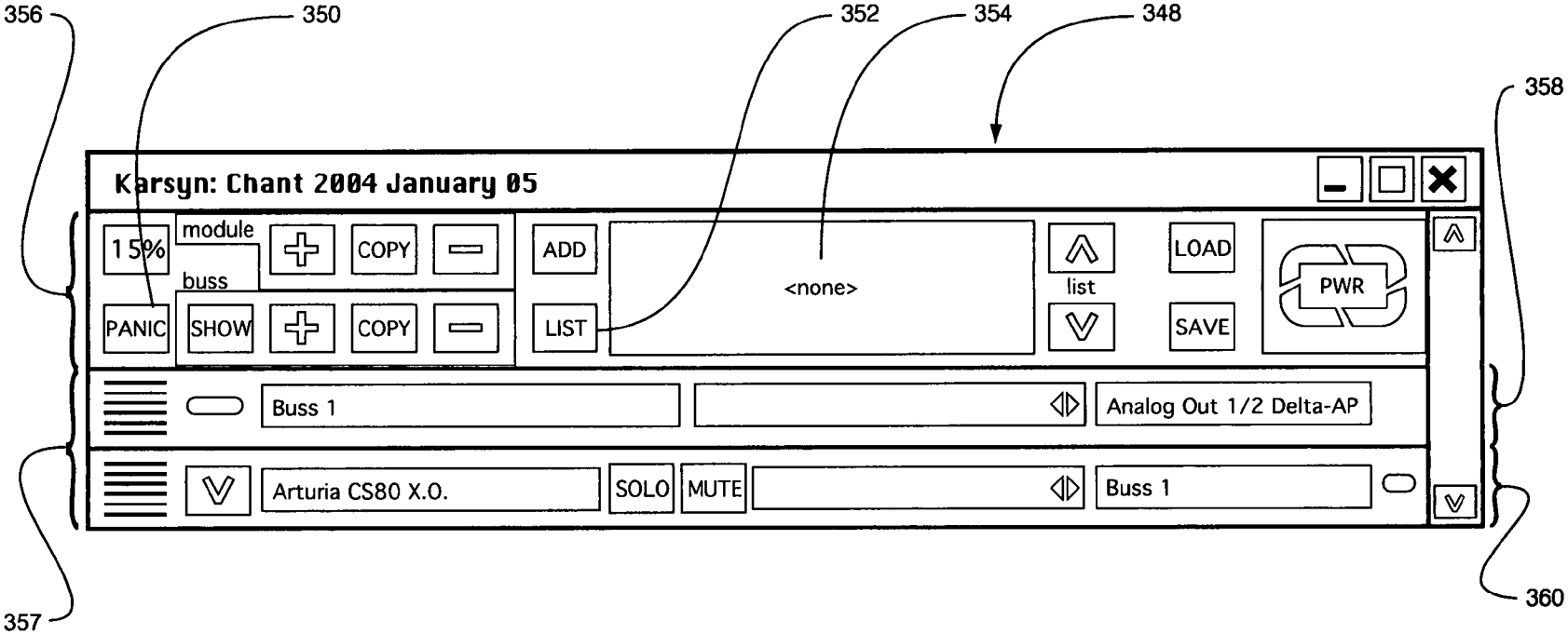
FIG. 16 is and illustration of an improved control interface for a host application.

FIG. 16 illustrates a software control interface for a host application running on the present invention. This interface has features not found in other host control panels. For example, a panic control 350 and a list control 352. The panic control 350 allows the user to turn all notes off. The list control toggles between a single instrument or channel in window 354 and the list of all instruments and channels. In an alternative embodiment it can toggle to all active instruments and channels in window 354. Below the control bar 356 in FIG. 16, there are two rows 357 the first row 358 is an output channel and the second row 360 represents a single instrument. In operation, there would typically be multiple channel bars—one for each output channel and multiple instrument bars for multiple inputs and VST "voices" or instruments. The control surfaces of the control bar 356 and the instrument and channel rows 360 and 358, respectively, are large to accommodate finger control of these functionalities when used in conjunction with a touch screen HID (human interface device). Although not shown in the figures, the present system is able to determine if a touch screen is installed or connected to the instrument and automatically configure the control interface with larger control surfaces. However, in the preferred embodiment the user is provided with the option of configuring the control interface to me more suitable for use with a pointer device (i.e. smaller control surfaces to fit more channels/instruments on the screen at once). In the preferred embodiment, the relative size of the control surfaces is optimized dependant on the application used and the HID interfaces plugged into the system and the user is capable of scaleably adjusting the size of the control interface control surface to suit her needs.

Figure 17:
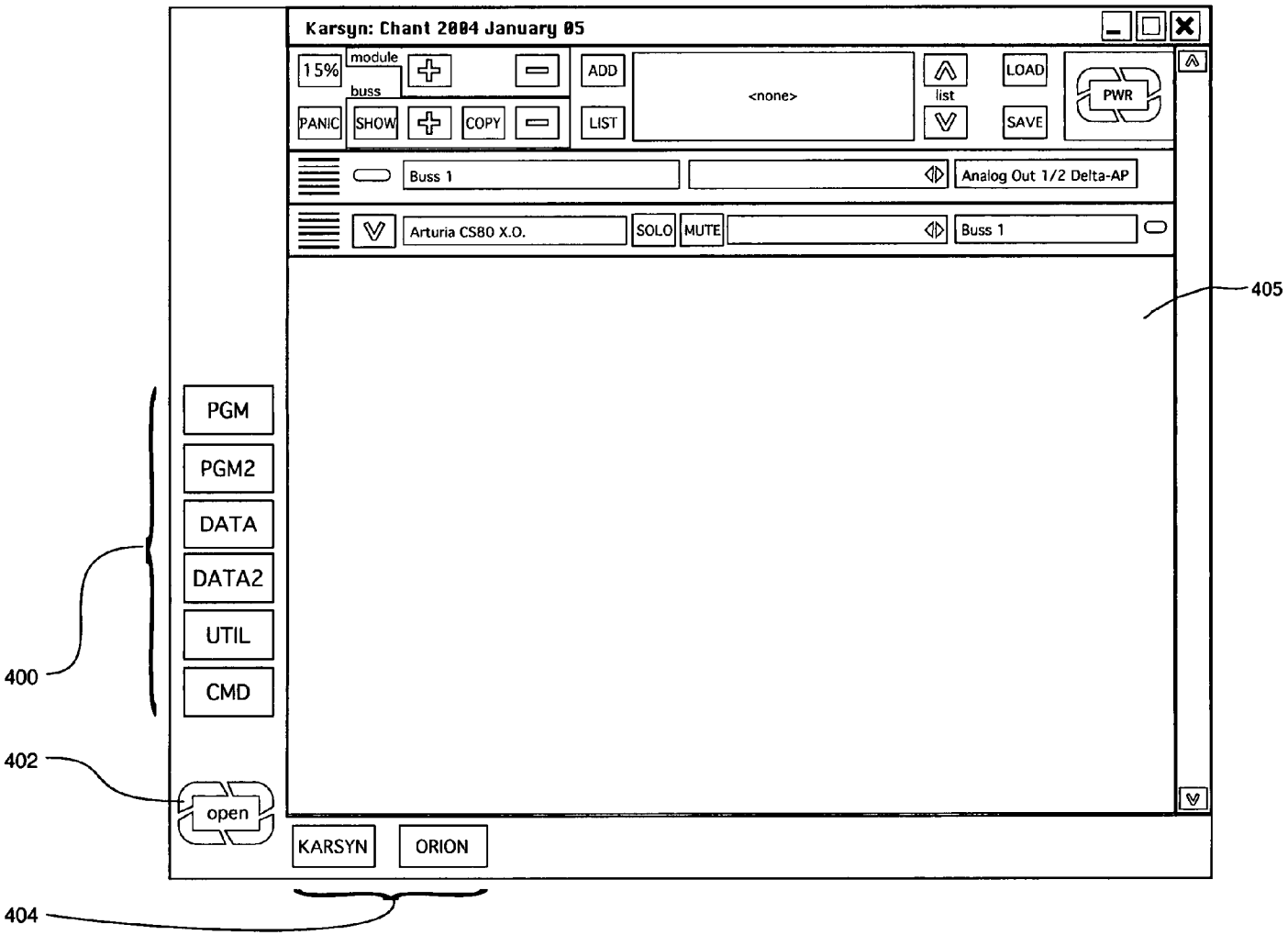
FIG. 17 is an illustration of an embodiment of the system launcher.

FIG. 17 is an illustration of an alternative embodiment of the launcher application previously illustrated and discussed above. The launcher controls 400 are seen at Left hand side of the screen on top of the main launcher control 402. In the embodiment illustrated, entering the main launcher control 402 brings the user to the main menu with the following control selections: CMD, UTIL, DATA 2, DATA, PGM 2 and PGM. The active applications are indicated on the bottom of the display 404. The open application window(s) 405 are above the active application/window indicators 404 and to the right of the launcher controls 400. In alternative embodiments the Launcher controls and the active application indicators are capable of being hidden to make more room for the application windows and returned to the front.

Figure 18:
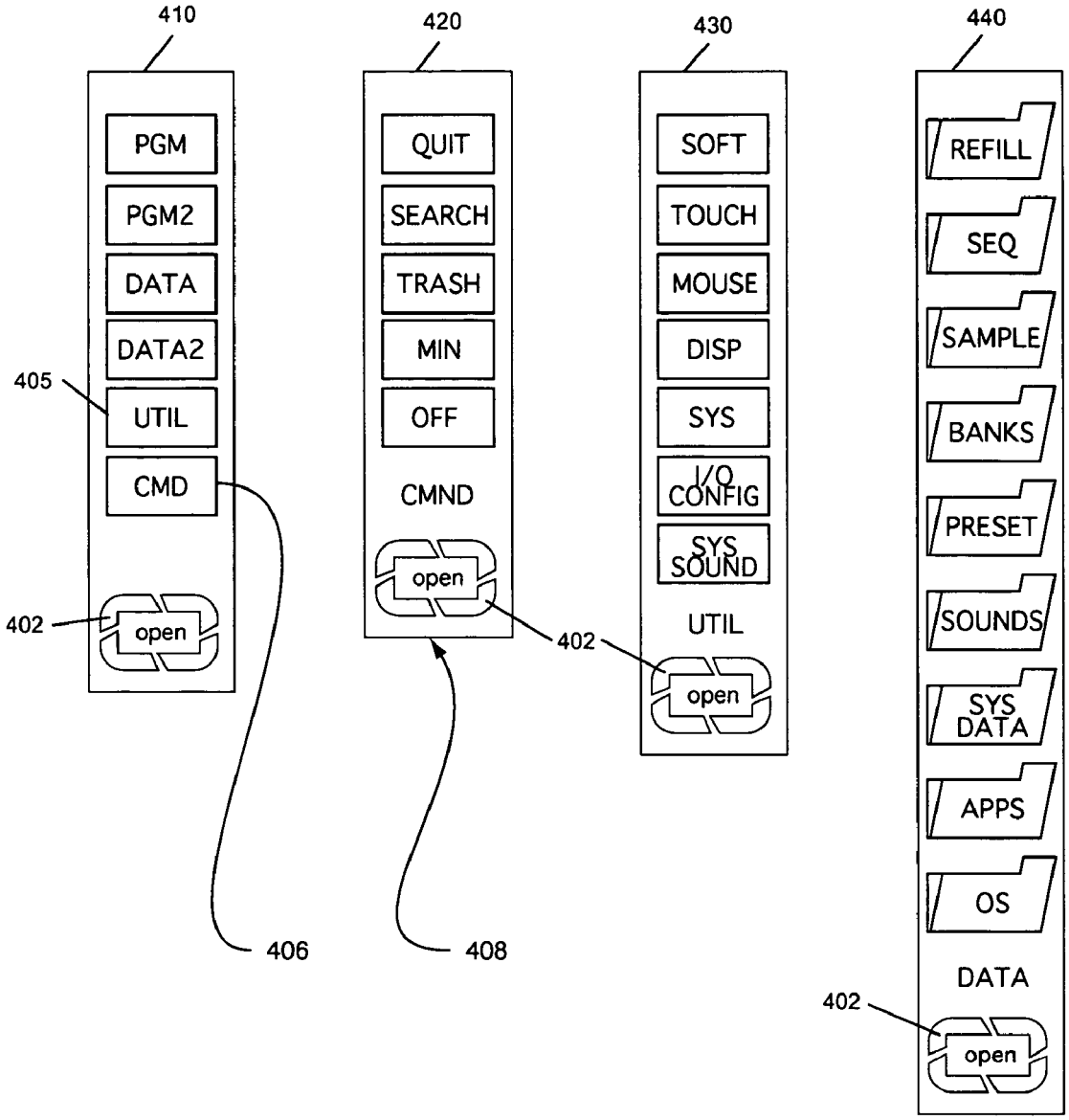
FIG. 18 is an illustration of an embodiment of different launcher menus.

FIG. 18 illustrates a break out of launcher controls and their respective subcontrols. The main control 402 always returns the launcher to the main menu 410. The CMD control 406 pulls up the CMD control menu 420 which includes the following commands: QUIT, SEARCH, TRASH, MIN, & OFF. The QUIT command opens a confirmation window (not shown) that the user would like to quit the launcher application. The SEARCH command opens a conventional search or explorer window (not shown). The TRASH command opens a recycle bin window (not shown). The MIN command minimizes all of the active windows and drops them to the bottom active application/window indicator 404. To expand a desired application/window the desired thumbnail in active indicator 404 is selected. The OFF command opens a window (not shown) that gives options of canceling the instruction, saving all the active files and turning off the instrument or turning off the instrument without saving the active files.

Returning the main command control menu 410, the UTIL command 405 opens a sub command menu 430 including the following subcommands: SOFT, TOUCH, MOUSE, DISP, SYST, I/O CONFIG, and SYS SOUND. The SOFT command opens a window (not shown) that allows the user to add or remove software. The TOUCH command opens a window (not shown) with controls for configuring the Touch screen HID. The MOUSE command opens a window (not shown) that allows the user to control other HID devices. The DISP command opens a window (not shown) that allows the user to configure the display. The SYST command opens a window (not shown) that allows the user to configure the operating system. The I/O CONFIG command opens a window (not shown) that allows the user to configure the input modules discussed above. The SYS SOUND command opens a window (not shown) to configure the operating system sounds.

Returning to the main command control menu 410, the DATA 2 command opens a subcommand menu 440 for user configurable file structure for user data. The DATA command opens the DATA sub command menu with the following sub commands: REFIL, SEQ, SAMPLE, BANKS, PRESET, SOUNDS, SYS DATA, APPS, OS. The REFIL command opens a window (not shown) of refills from/for Reason (a selectable software application. The SEQ command opens a window (not shown) comprising a library of sequences The SAMPLE command opens a window (not shown) comprising of a library of samples. The BANKS command opens a window (not shown) comprising a library of Banks which are groups of presents. The PRESET command opens a window (not shown) comprising a library of groups of sounds or instruments. The SOUND command opens a window (not shown) of a library of individual VST apps or sound libraries. The DATA command opens a window (not shown) that allows the user to look at the files from and operating system level. The APPS command opens a sub command menu (not shown) with individual subcommands which open different applications or sub-subcommand menus (not shown) for classes of applications. The OS command opens a window (not shown) which opens the file explorer/finder for the operating system. Other embodiments or breakouts of the commands is possible and the launcher allows the user to reconfigure the commands and to add commands that open specific file directories, files and/or applications.

Figure 19:
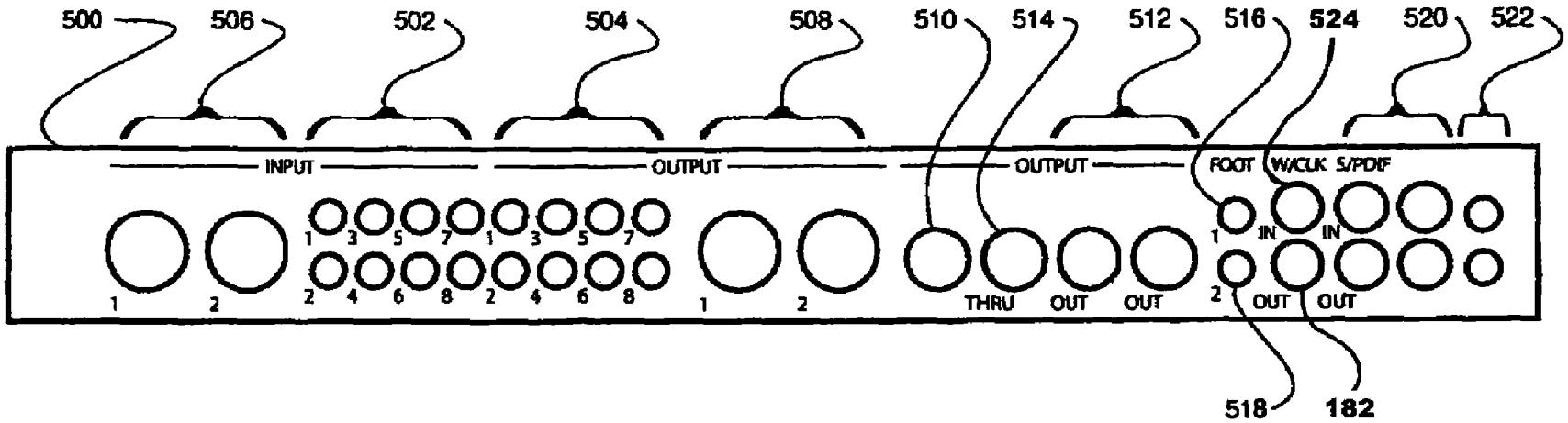
FIG. 19 is an illustration of an embodiment of an audio output module.

FIG. 19 illustrates an alternative embodiment of an audio input/output module 500. The audio inputs and outputs are supported by commercially available audio PCI cards and other circuitry well known in the audio electrical arts. The embodiment shown has the following inputs/outputs: 8 analog inputs 502 and 8 analog outputs 504 in the form of ¼ inch sockets for receiving ¼ inch headphone plugs. Two balanced analog inputs 506 in the form of female XLR connectors. These inputs are selectable between line level and microphone level. Two balanced analog outputs in the form of male XLR connectors 508; a midi port 510; two identical midi out ports 512; a midi Thru port 514; a foot control ¼ inch headphone socket input 516; ¼ inch headphone jack out socket 518; a digital word clock 524; a digital word clock out 525; four digital channels (two in, two out, two coaxial with BNC connections and two optical) 520 and two RCA jack ports 522. In one embodiment of the invention the audio input and output are supported by up to 24 bit resolution at 96 Khz which is higher than the standard CD quality resolution which is typically 16 bit resolution at 44 Khz.

Figure 20:
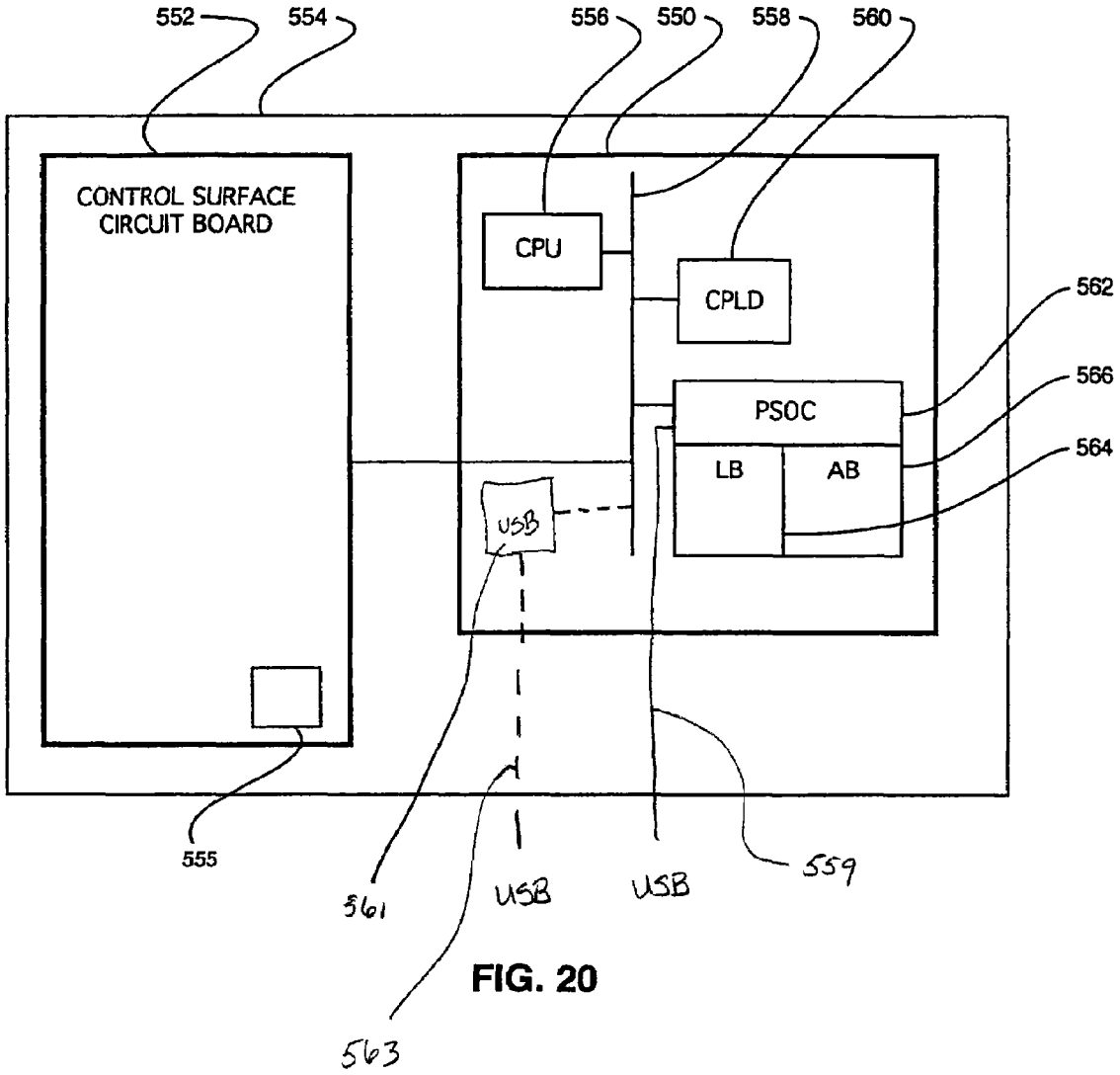
FIG. 20 is an illustration of an embodiment of control module circuitry with a separate universal programmable control engine board.

FIG. 20 illustrates an interchangeable universal programmable control engine and USB communication board 550. This programmable control engine board 550 in combination with the control surface circuit board 552 comprises the electronic components of the control module 554. In one embodiment, these boards are directly connected to each other via a socket connector (not shown) male on one board female on the other. In alternative embodiments the data bus 558 is connected by cabling. In one embodiment of the invention the control surface circuit board 552 contains circuitry or components such as an EE PROM 555 that contain identification keys that is communicated with the control engine board 550. The control engine board 550 takes the key information and configures itself to behave in accordance with the identity of the control surface board 552. In alternative embodiments the control engine board 550 is configured by the main system in accordance with the identity stored information communicated by the control surface board 552.

The control engine board 550 includes a CPU 556 which is connected to a data bus 558 for transmitting information to and from other components on the control engine board 550 and the control surface board 552. In one embodiment of the invention the applicants used an 8 bit databus. A programmable logic device PLD chip (in the present embodiment employs a CPLD) 560 is also connected to the control engine board 550 and its data bus 558. This chip serves as a scaler for the CPU 556 chip. That is, it scales the number of inputs that can be feed into the CPU for processing. It allows for a design using a CPU chip with far less leads. For example, the CPLD had more leads so it can collect information from more sources simultaneously. Additionally, the CPLD chip 560 can take care of other tasks for the CPU such as precounting of an encoder mounted on the control surface circuit board 552 freeing up the CPU to handle more difficult tasks. Depending on the tasks the CPLD can perform encoder output counting in whole or in part for the CPU.

The control engine board 550 also includes a PSOC 562 (programmable system on chip processor) also connected to the control engine bus 558. The PSOC chip includes a combination of a number of logic blocks 564 and analog blocks 566 and supporting components like RAM and ROM (not shown). The PSOC logic blocks and analog blocks can be configured to perform a wide variety of tasks according to the manufacturers specifications (the PSOC chosen by the applicants is available from Cyprus semiconductor). For example, some of the logic and analog blocks can be used as A/D converters (analog to digital). Other blocks can be used as D/A converters (digital to analog). The PSOC 562 can also be configured as: a UART or IRDA modem for digital communications; a band pass filter, a low pass filter; as additional memory for the system; an LCD display driver; a multiplexer to reuse configurations for multiple tasks; a random number generator; measure the operating temperature of the chip, a timer or clock; a DTMF (dual tone multifrequency or "touch tone") decoder; and many other functional configurations. A combination of the control engine CPU 556, the CPLD scaler 560, and the flexibility of the PSOC 562 allow the control engine 550 to convert the control surface boards into USB devices that can communicate with the CPU of the instrument 100. The control engine 550 may communicate via a USB data bus 559 connected to the PSOC 562 in some embodiments. In other embodiments, optional USB circuitry 561, which is connected to the data bus 558, provides a USB connection 563 to the instrument 100. The advantage of having a separate programmable control module USB control engine board is that the board can be universal to all the control modules and makes it a great deal easier to develop new control modules to exchange with other control modules.

FIG. 20 also illustrates another unique feature of the control modules. The control surface board 552 contains circuitry 555 which includes a key that is used by the USB control engine 550 that is used by the control engine to configure itself so that the control surface board together with the universal interchangeable control engine board 550 have a behavioral personality consistent with the control surface board 552. For example if the control surface board 552 is for an array of encoders the control engine board 550 must act differently on the inputs than if the control surface board 552 is for an array of sliders. If the combined on board memory of the control surface board 552 and the control engine board 550 is sufficiently large to hold driver software the control module 554 could operate as a stand alone USB peripheral device.

Depending on the design of the control engine board 550 more processing power may be necessary than the control engine board can handle. Since the Control surface board 552 is connected to the control engine board 550 on the same data bus 558 as the bus that handles communication between the control engine CPU 556 and the CPLD 560 and PSOC 562, the control surface board may include additional CPLD's and/or PSOCs to handle more of the processing necessary for the control module 554 to behave like a USB peripheral device.

The present invention allows for many different business models. For example, the musical instrument can be sold as hardware regardless of the presence of lack of presence or any proprietary and/or nonproprietary sound generation software. Proprietary sound generation software could be sold separately. In the case of open source software, a vendor could provide services for which it is compensated through licensing revenue. These services might include promulgating standards for the open source program, validating through review and testing that suggested improvements are in conformity with the standards and are compatible with other systems or system components and promulgate official approved versions of the open source software for which it charges a the user of the validated version of the software a license fee. Validated versions of the software would provide users with a higher level of confidence in the performance of the software.

While the present invention has been described with reference to particular embodiments, it may be understood that the embodiments are illustrative and that the invention scope is not so limited. Any variations, modifications, additions and improvements to the embodiments described are possible. These variations, modifications, additions and improvements may fall within the scope of the invention as detailed within the following claims.

We claim:

1. An electronic musical performance instrument comprising:

a first modular control module comprising:

a first musical instrument input interface manipulatable by a human operator; and a first control engine electronic circuitry being connected to the first musical instrument input interface, the first control engine electronic circuitry receives human operator input representations when the first musical instrument input interface is manipulated, the first control engine electronic circuitry provides an output that comprises a first manipulation representation in an electronic format;

a second modular control module comprising:

a second musical instrument input interface manipulatable by a human operator; and a second control engine electronic circuitry being connected to the second musical instrument input interface, the second control engine electronic circuitry receives human operator input representations when the second musical instrument input interface is manipulated, the second control engine electronic circuitry provides an output that comprises a second manipulation representation in the electronic format; the first control engine electronic circuitry and the second control engine electronic circuitry being interchangeable; and a motherboard adapted to run a general purpose computer operating system, the general purpose computer operating system being configured to enable the motherboard to run at least one user selected sound software packages to generate sound signals using the first manipulation representation and the second manipulation representation.

2. The electronic musical performance instrument of claim 1, wherein the first modular control module is removably connected to the motherboard and exchangeable with a third modular control module.

3. The electronic musical performance instrument of claim 1, wherein the first modular control module is removably attached to the electronic musical performance instrument and exchangeable with a third modular control module.

4. The electronic musical performance instrument of claim 1, wherein the electronic format is MIDI.

5. The electronic musical performance instrument of claim 1, wherein the electronic format is USB.

6. The electronic musical performance instrument of claim 1, wherein the first control engine electronic circuitry further comprises:

a data bus that connects the first control engine electronic circuitry to the first musical instrument input interface;

a CPU connected to the data bus;

a programmable logic device (PLD) connected to the data bus; and a programmable system on chip (PSOC) processor connected to the data bus.

7. The electronic musical performance instrument of claim 6, wherein the CPU, the PLD and the PSOC processor operate together to convert the human operator input representations from the first musical instrument input interface into the electronic format.

8. The electronic musical performance instrument of claim 6, wherein the first control engine electronic circuitry further comprises a USB circuit connected to the data bus, the USB circuit comprises a USB connection for the motherboard.

9. The electronic musical performance instrument of claim 1, wherein the first musical instrument input interface comprises:

at least one human interface device; and a non-volatile memory device containing a configuration key, the configuration key containing a configuration information for use by the first control engine electronic circuitry so as to operate in conjunction with the first musical instrument input interface.

10. An electronic sound performance instrument comprising:

a motherboard adapted to run a computer operating system, the computer operating system being configured to enable the motherboard to run at least one user selected sound software package to generate sound signals;

a plurality of control module slots;

a first modular control module adapted to be removably positionable in any of the plurality of control module slots, the first modular control module comprising:

a first control surface circuit comprising an instrument input interface, which produces a first manipulation signal in response to human operator manipulation of a first control input; and a first control engine circuit electrically connected to the first control surface circuit, the first control engine circuit receives the first manipulation signal and produces a first modular control module output, the first modular control module output being provided to the motherboard; and a second modular control module adapted to be removably positionable in any of the plurality of control module slots, the second modular control module comprising:

a second control surface circuit comprising an instrument input interface, which produces a second manipulation signal in response to human operator manipulation of a second control input; and a second control engine circuit being interchangeable with the first control engine circuit, the second control engine circuit electrically connected to the second control surface circuit, the second control engine circuit receives the second manipulation signal and produces a second modular control module output, the second modular control module output being provided to the motherboard; the at least one user selected sound software package uses the first modular control module output and the second modular control module output to generate the sound signals.

11. The electronic sound performance instrument of claim 10, wherein the first control engine circuit and the second control engine circuit are substantially identical.

12. The electronic sound performance instrument of claim 10, wherein the first control engine circuit further comprises:

a data bus;

a CPU connected to the data bus;

a programmable logic device (PLD) connected to the data bus; and a programmable system on chip (PSOC) processor connected to the data bus.

13. The electronic sound performance instrument of claim 12, wherein the first control engine circuit is electrically connected to the first control surface circuit by the data bus.

14. The electronic sound performance instrument of claim 12, wherein the CPU, the PLD and the PSOC processor operate together to convert the first manipulation signal into the first modular control module output, the first modular control module output being in a standardized signal format.

15. The electronic sound performance instrument of claim 12, further comprising USB circuitry connected to the data bus, the USB circuitry receives a representation of the first manipulation signal and outputs the representation of the first manipulation signal in a USB format.

16. The electronic sound performance instrument of claim 10, wherein the first modular control module output comprises MIDI format.

17. The electronic sound performance instrument of claim 10, wherein the first modular control module output further comprises USB format.

18. The electronic sound performance instrument of claim 10, wherein the first manipulation signal comprises MIDI format.

* * * * *